US007185803B1

(12) United States Patent
Lutzke

(10) Patent No.: US 7,185,803 B1
(45) Date of Patent: Mar. 6, 2007

(54) MAILBOX MOUNTING ASSEMBLY

(76) Inventor: David E. Lutzke, 5505 Regent St., Madison, WI (US) 53705

( * ) Notice: Subject to any disclaimer, the term of this patent is extended or adjusted under 35 U.S.C. 154(b) by 0 days.

(21) Appl. No.: 11/534,301

(22) Filed: Sep. 22, 2006

Related U.S. Application Data

(63) Continuation-in-part of application No. 11/325,725, filed on Jan. 5, 2006.

(51) Int. Cl.
*A47G 29/12* (2006.01)

(52) U.S. Cl. ..... 232/39; 248/218.4

(58) Field of Classification Search ..... 232/39; D99/32; 248/218.4, 219.1, 219.2, 219.3, 248/219.4, 300
See application file for complete search history.

(56) References Cited

U.S. PATENT DOCUMENTS

| | | | | |
|---|---|---|---|---|
| 2,440,576 | A | 4/1948 | De Haas | |
| 2,552,915 | A * | 5/1951 | Zachrich | 248/154 |
| 4,120,446 | A | 10/1978 | Fuemmeler | |
| 4,403,730 | A | 9/1983 | Batson | |
| 4,709,853 | A | 12/1987 | Hahn | |
| 4,724,998 | A | 2/1988 | Long et al. | |
| 4,951,905 | A | 8/1990 | Bronson et al. | |
| 4,966,309 | A | 10/1990 | Baer | |
| 5,060,908 | A | 10/1991 | Sofy | |
| 5,169,062 | A | 12/1992 | Baker | |
| 5,337,954 | A | 8/1994 | Kobilarcik et al. | |
| 5,386,938 | A | 2/1995 | West | |
| 5,509,603 | A | 4/1996 | Hering | |
| 5,664,748 | A | 9/1997 | Speece et al. | |
| 6,402,023 | B1 | 6/2002 | Beaudry et al. | |
| 6,955,291 | B1 | 10/2005 | Knight | |
| 2005/0127259 | A1 | 6/2005 | Riker | |

* cited by examiner

*Primary Examiner*—William L. Miller
(74) *Attorney, Agent, or Firm*—Stiennon & Stiennon

(57) ABSTRACT

A conventional mailbox is mounted to a dimensioned lumber post by a mailbox mounting assembly having a main bracket which mounts to two perpendicular faces of the post by two perpendicular flanges. The main bracket has a horizontal top wall from which two diverging sidewalls extend downwardly. The top wall has two sets of perpendicular slots, which receive two parallel right angle top brackets to receive the mailbox in a position either partially overlying the top of the post, projecting from the post, or offset from the post in a transverse orientation. Another embodiment has a main bracket with an integral top bracket, and only one adjustable top bracket. Yet another embodiment has two mirror image brackets which mount to different size mailboxes by their position with respect to each other on a post.

19 Claims, 4 Drawing Sheets

MAILBOX MOUNTING ASSEMBLY

CROSS REFERENCES TO RELATED APPLICATIONS

This application is a continuation-in-part of U.S. application Ser. No. 11/325,725, filed Jan. 5, 2006, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to brackets in general, and to assemblies for connecting mailboxes to posts in particular.

Stanchion mounted mailboxes have been associated with rural areas as postal carriers seldom travel the long, rugged driveways associated with farms or remote locations. More recently, efforts to obtain greater letter carrier efficiency have meant that mail deliveries to the homeowner's door have been curtailed for newer construction, making the roadside mailbox more prevalent in suburbia, and even in newer urban developments.

Most roadside mailboxes are mounted to a post in order to elevate the mail receptacle in a manner conducive to drive-up usage by a postal carrier working out of a truck or car, thereby increasing the efficiency of mail delivery. The post in many cases is made of wood due to its low cost and ability to withstand the rigors of outdoor use. In addition, wood posts offer adequate strength and classic appeal in a variety of settings.

In one common configuration, a wooden cross member or arm is connected to a wooden post at a height adequate for drive-up usage. The arm provides support for the mailbox cantilevered from the post. The cantilever provided by the arm is important as in many situations the postal worker must contend with curbs or ditches that reduce the allowable distance from the vehicle to the mailbox. Although the cantilever offers a positioning benefit, it also creates a lever action that places stress on the joint with the post. As a result of this stress, and the natural movement of wood as it expands and contracts, the joint between the post and the arm is a significant point of failure. Even if the joint doesn't completely fail, over time the arm may become loose and sag. To prevent sagging or deflection, the arm is sometimes braced by another wooden member extending between the arm and the post. In addition to these two members, post mounted mailboxes also require additional components, fabricated from wood, plastic, or steel that serve as the mounting apparatus for the mail box itself. In some cases the mounting apparatus is an assembly of small brackets, however in most cases it is a mounting board. The board is attached to the cantilever arm, and the mailbox is then attached to the mounting board.

The usual method of construction of the cantilevered arm involves a tongue on the arm which extends into a groove or recess on the post. This traditional wood joinery technique requires skills and equipment not possessed by all homeowners. As a result, mass produced kits are available, but often such assemblies can be lacking in a desired quality of fit and appearance.

Various specialized mounting brackets are available, either configured to a specialized mailbox, or designed to mount a standard mailbox in a specified fashion. Preferably a single bracket would offer a variety of mounting options to the user.

SUMMARY OF THE INVENTION

The mailbox mounting assembly of this invention mounts a conventional mailbox to a standard dimensioned lumber post. The mounting assembly has a main bracket which mounts to two perpendicular faces of the post by two perpendicular flanges. The main bracket has a horizontal top wall from which two diverging sidewalls extend downwardly. The top wall has two sets of perpendicular slots, which receive two parallel right angle top brackets to receive the mailbox in a position either partially overlying the top of the post, projecting from the post, or offset from the post in a transverse orientation. Another embodiment has a main bracket with an integral top bracket, and only one adjustable top bracket. Yet another embodiment has two mirror image brackets which mount to different size mailboxes by their position with respect to each other on a post.

It is an object of the present invention to provide a universal mounting assembly for mailboxes of various widths for attachment to wooden posts in a variety of positions.

It is a further object of the present invention to provide a mounting assembly for mailboxes which can be economically fabricated of sheet metal.

It is another object of the present invention to provide a mounting assembly for mailboxes which can be nested compactly with other like assemblies for economical transport and display.

Further objects, features and advantages of the invention will be apparent from the following detailed description when taken in conjunction with the accompanying drawings.

DESCRIPTION OF THE PREFERRED EMBODIMENTS

Figure 1:
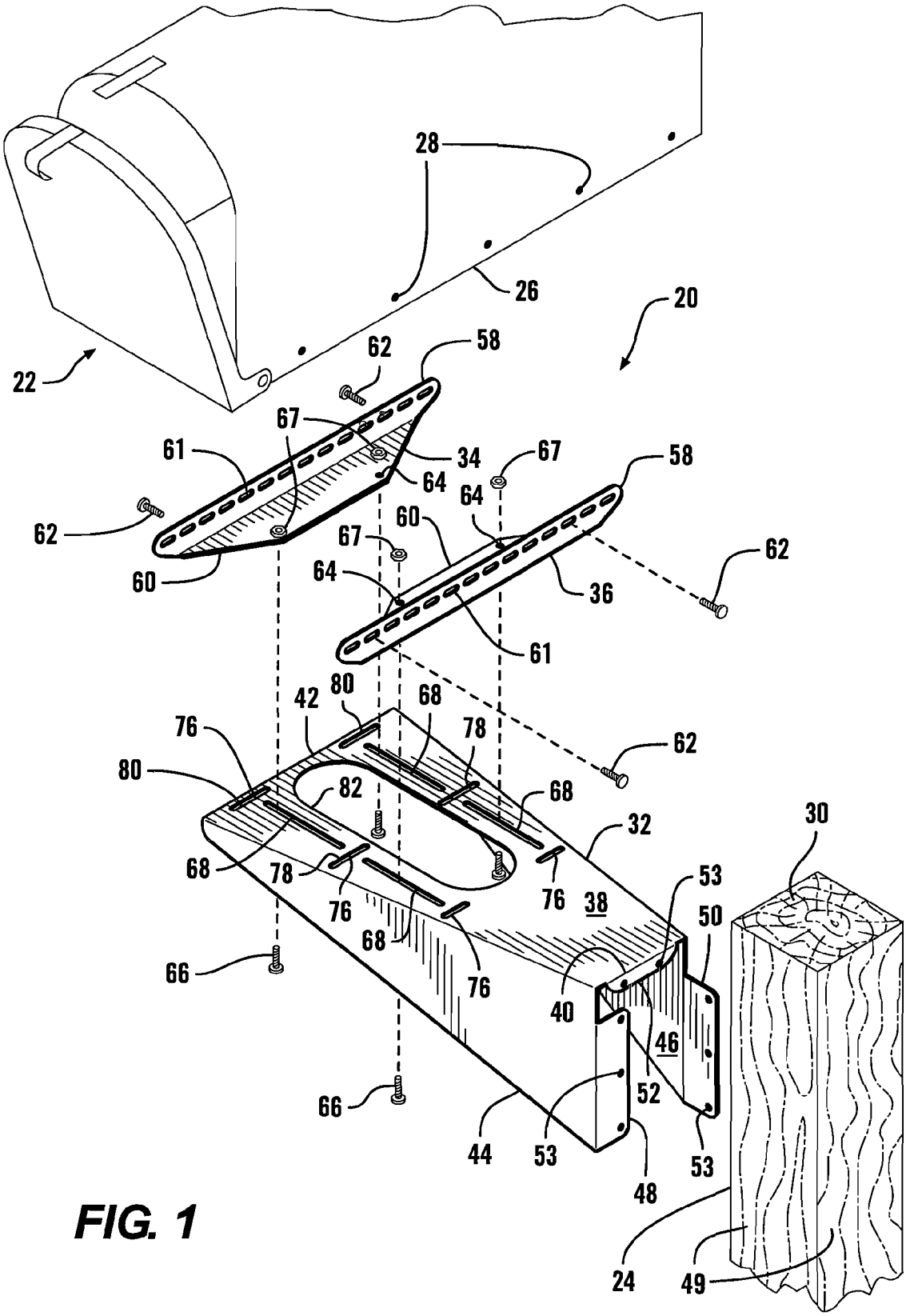
FIG. 1 is an exploded isometric view of the mailbox mounting assembly of this invention.
Figure 2:
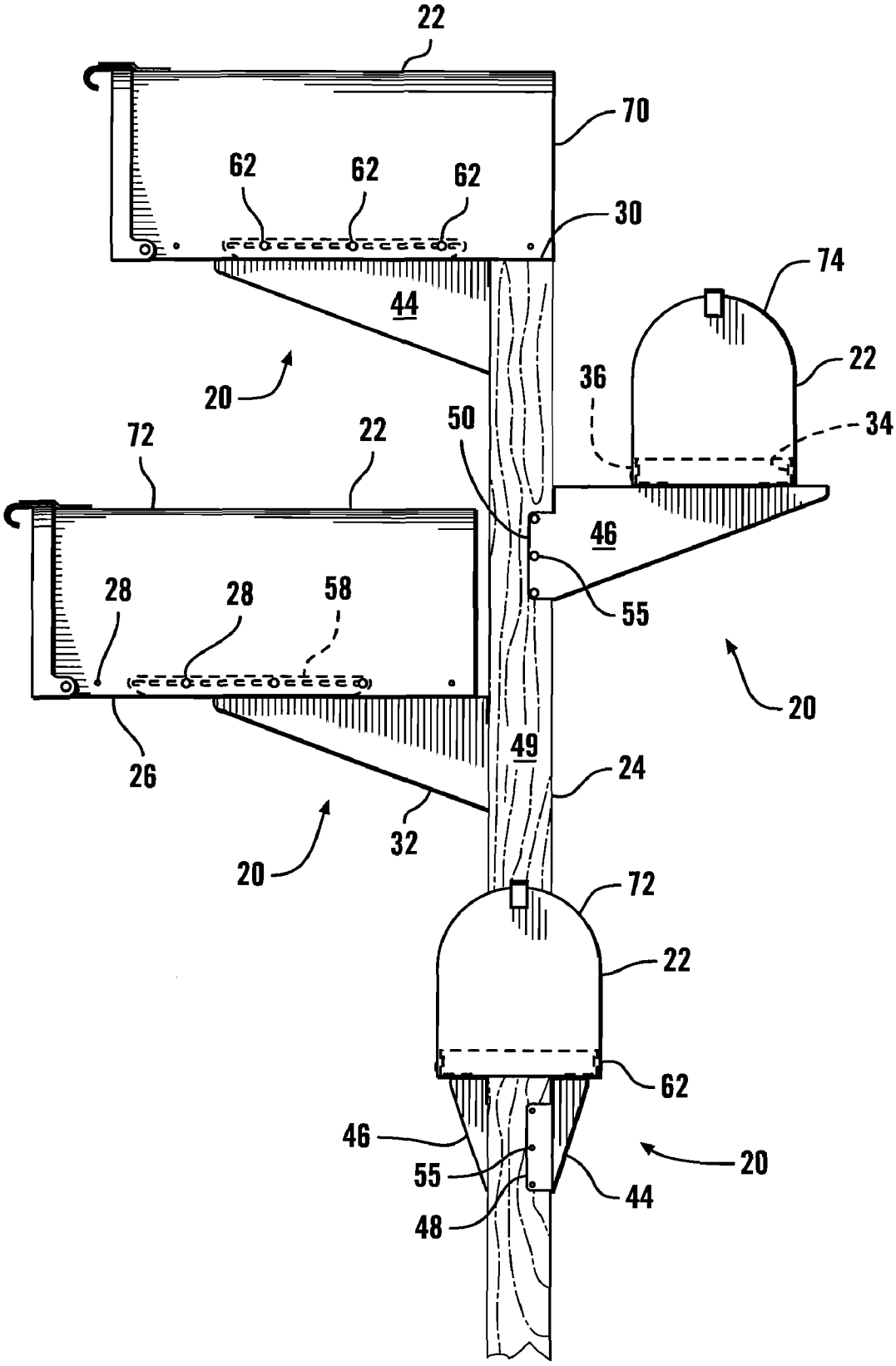
FIG. 2 is a front elevational view of the mailbox mounting assembly of FIG. 1, mounted to a wooden post in various configurations.

Referring more particularly to FIGS. 1–4, wherein like numbers refer to similar parts, a mailbox mounting assembly 20 is shown in FIGS. 1 and 2. The assembly 20 securely mounts a conventional mailbox 22 to a conventional wooden post 24. Mailboxes 22 are available in a variety of sizes and heights, but usually have downwardly projecting lips 26 which are provided with mounting holes 28 which extend sidewardly through the lips 26. The post 24 will typically be a treated dimensioned lumber member, with nominal dimensions of 4×4 inches (actual dimensions of about 3½ by 3½ inches), 4×6, or 6×6 inches. The post 24 has a lower end, not shown, which extends into the ground or is otherwise fastened, and an upper end 30 to which the mailbox 22 is attached by the mounting assembly 20.

The mailbox mounting assembly 20 has a single main bracket 32 to which a first top bracket 34 and a second top bracket 36 are positionably connected. As shown in FIG. 1, the main bracket 32 is formed of bent sheet metal, for example galvanized, painted, or powder coated steel, or any other weather resistant material. The thickness of the metal sheet may be for example, 18–20 gauge. The main bracket 32 has a horizontal top wall 38 which underlies the mailbox 22. The main bracket 32 top wall 38 is in the shape of a truncated triangle, and expands in width as it extends from a post edge 40 which is adjacent the post 24. The top wall 38 is at its widest at its furthest from the post where it terminates at a free edge 42. A first side wall 44 and a second side wall 46 are spaced from one another, and extend downwardly from the main bracket top wall 38. Although both side walls 46 are perpendicular to the top wall 38, they are not parallel to each other, but instead diverge as they extend away from the post 24. This divergence provides greater clearance when it comes to fastening the main bracket 32 to the post 24, and facilitates nesting of brackets 32, as discussed below.

The main bracket 32 is mounted to the post 24 by a rear flange 48 which extends from the first side wall 44 in a plane which is perpendicular to the top wall 38, a side flange 50 which extends from the second side wall 46 in a plane which is perpendicular to the top wall and to the rear flange. The rear flange 48 and the side flange 50 are positioned to engage perpendicular faces 49 of the upright post 24. Because of this perpendicular arrangement of the flanges, when both flanges 48, 50, are engaged with perpendicular faces of the upright post 24, the top wall will be horizontal (assuming the post is truly vertical). A top flange 52 preferably extends downwardly perpendicular to the top wall, and provides a further fastening location. Each of the side flange 50, the top flange 52, and the rear flange 48 has a plurality of attachment holes 53, through which fasteners 55, shown in FIG. 2, extend into the post. The fasteners 55 may be nails or screws, for example 1⅝ inch long deck screws.

The first top bracket 34 and the second top bracket 36 are connected to the main bracket 32 and serve to mount the mailbox 22 to the main bracket. The two top brackets 34, 36 are identical, and each has a side segment 58 which extends upwardly from a bottom segment 60. The side segments 58 have a plurality of side fastener openings or slots 61. The side slots 61 are positioned to mate with the mounting holes 28 in the downwardly projecting lips 26 of the mailbox 22, and to be fastened thereto by fasteners 62, as shown in FIG. 2. The fasteners 62 will engage with nuts, not shown, on the interior of the lips 26. The bottom segments 58 each have two fastener holes 64 which are spaced a set distance from each other. Each fastener hole 64 may have nuts 67 fixed to the bottom segments aligned with the holes 64. The nuts 67 may be PEMsert® inserts available from PennEngineeing, of Danboro, Pa.

As shown in FIG. 2, the mailbox mounting assembly 20 may be attached to the mailbox and the post 24 in several ways. The mailbox 22 may be positioned in a top mounting arrangement 70 in which portions of the mailbox overlie the upper end 30 of the post, and extends in the first direction of the main bracket. Alternatively, the mailbox may be positioned in an intermediate arrangement 72 in which the mailbox 22 is projecting out from the post 24, but still extending in the first direction of the main bracket.

The first top bracket 34 and the second top bracket 36 are connected to the main bracket 32 by screw fasteners 66, shown in FIG. 1, which extend through slots in the top wall 38 of the main bracket 32 and into the nuts 67. The top wall 38 has two sets of openings or slots to allow the mailbox 22 to be mounted either aligned with the long axis of the main bracket or perpendicular to the long axis of the main bracket 32. For mounting in a transverse arrangement 74, as shown in FIG. 1, the fasteners are connected through first slots 68. The first slots 68 extend in a first direction running from the post edge 40 to the free edge 42 of the main bracket top wall 38. There are two pairs of first slots 68, each pair being comprised of two parallel slots which extend in the first direction. The pairs of first slots 68 are spaced from each other in the first direction. Each of the screw fasteners 66 extends into one of the first slots 68. Because the first top bracket 34 and the second top bracket 36 will be fastened to the mailbox 22 when they are mounted to the main bracket 32, the fasteners are slidable within the first slots 68 until the mailbox is in the desired position, at which point the fasteners 66 may be tightened into the nuts 67 to fix the mailbox 22 in place.

To mount the mailbox 22 in a top mounting arrangement 70 in which portions of the mailbox overlie the upper end 30 of the post, as shown in FIG. 2, the fasteners 66 extend into two near end second slots 76 and two middle second slots 78. The near ends second slots 76 are aligned with each other and extend in a second direction which is perpendicular to the first direction. The middle second slots 78 are also aligned with each other and extend in the second direction. The middle second slots 78 are spaced from the near end second slots 76 the same distance as the set distance spacing between the two fastener holes 64 in the bottom segments of the first top bracket 34 and the second top bracket 36. Because the second slots extend in the second direction, they will accommodate a range of mailbox widths.

To mount the mailbox in an intermediate arrangement 72 in which the mailbox 22 is projecting out from the post 24, but still extending in the first direction, the fasteners 66 extend into the two middle second slots 78 and two far end second slots 80. The far end second slots 80 are aligned with each other and extend in the second direction.

The main bracket 32 top wall 38 is preferably provided with an access opening 82, shown in FIG. 1, which allows access to the bottom segments of the first top bracket 34 and the second top bracket 36 when installing the assembly 20 on a post.

It will be observed that the mailbox mounting assembly 20 permits mailboxes of a variety of sizes to be readily mounted to a post in a secure fashion by an unskilled craftsman in a variety of positions. The craftsman first fastens the side segments 58 of the first top bracket 34 and the second top bracket 36 to the downwardly extending lips 26 of the mailbox 22. The main bracket 32 is then mounted to the post 24 by aligning the rear flange and the side flange with the perpendicular vertical faces 49 of the post, and driving fasteners 55, either nails or screws, through the holes 53 in the flanges. The diverging first side wall 44 and second side wall 46 of the main bracket 32 provide adequate clearance to reach fasteners which pass through the rear flange and the top flange into the post 24. No level is required.

Once the top brackets 34, 36 are mounted to the mailbox, and the main bracket 32 is mounted to the post 24, it is a simple matter for the craftsman to mount the mailbox 22 and top brackets assembly to the main bracket in one of the three arrangements shown in FIG. 2. The craftsman sets the mailbox and top brackets assembly into place to align the holes in the top brackets with either first slots 68 or second slots 76, depending on the desired orientation of the mailbox, and then inserts threaded fasteners through the aligned openings, and engages the fasteners with the nuts 67.

Figure 4:
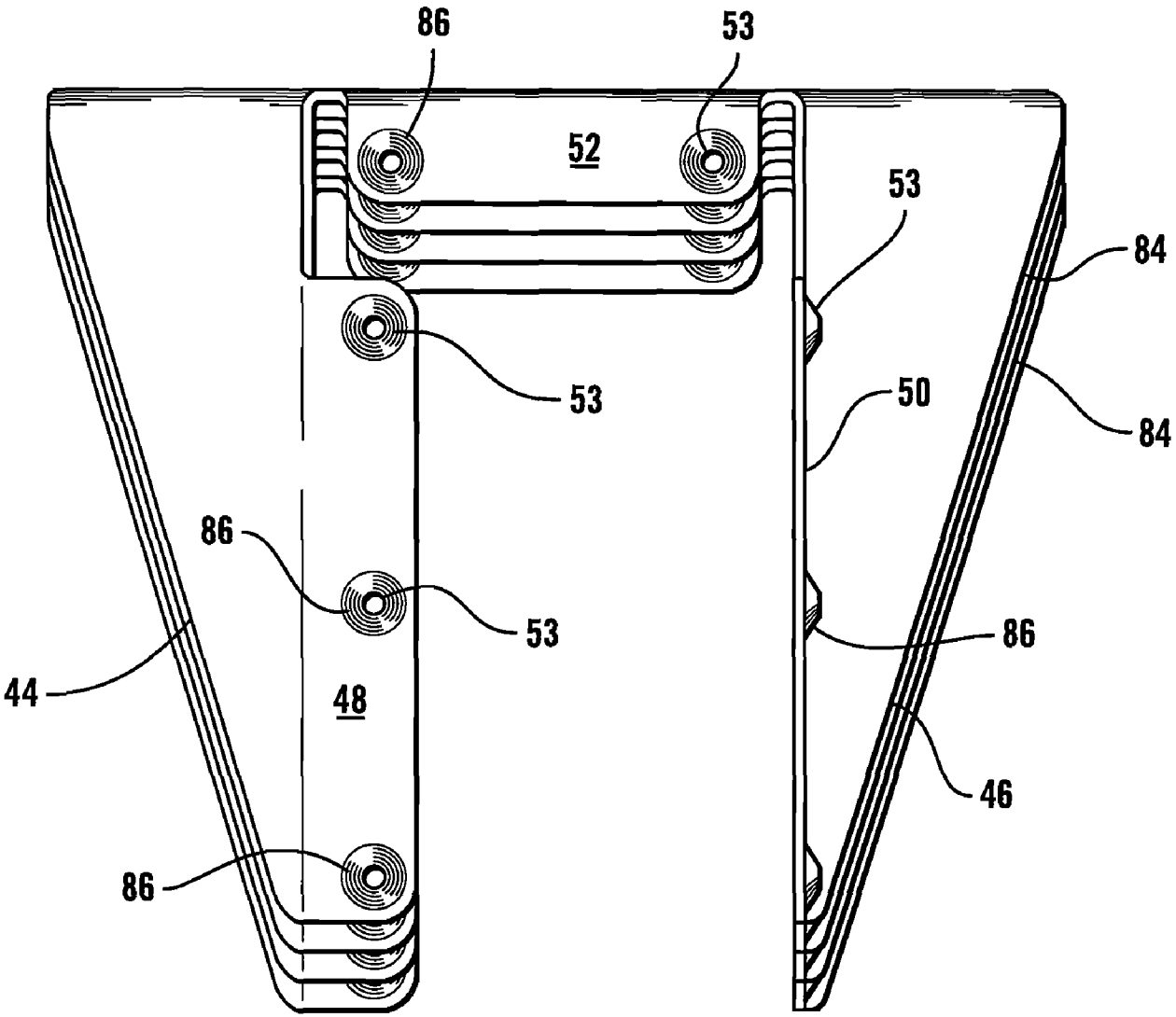
FIG. 4 is a rear elevational view of a stack of main brackets of an alternative embodiment mailbox mounting assembly of this invention having raised crowns around the mounting holes.

An alternative embodiment main bracket 84 is shown in FIG. 4 which is identical to the main bracket 32, but in which all the attachment holes 53 are surrounded by an upraised crown 86, so that fastening screws may be used which will leave no protruding head. The close nesting of the main brackets 84 which facilitates economical shipment and storage, is illustrated in FIG. 4. Because the side walls 44, 46 are not parallel, one main bracket can be compactly received within another.

Figure 3:
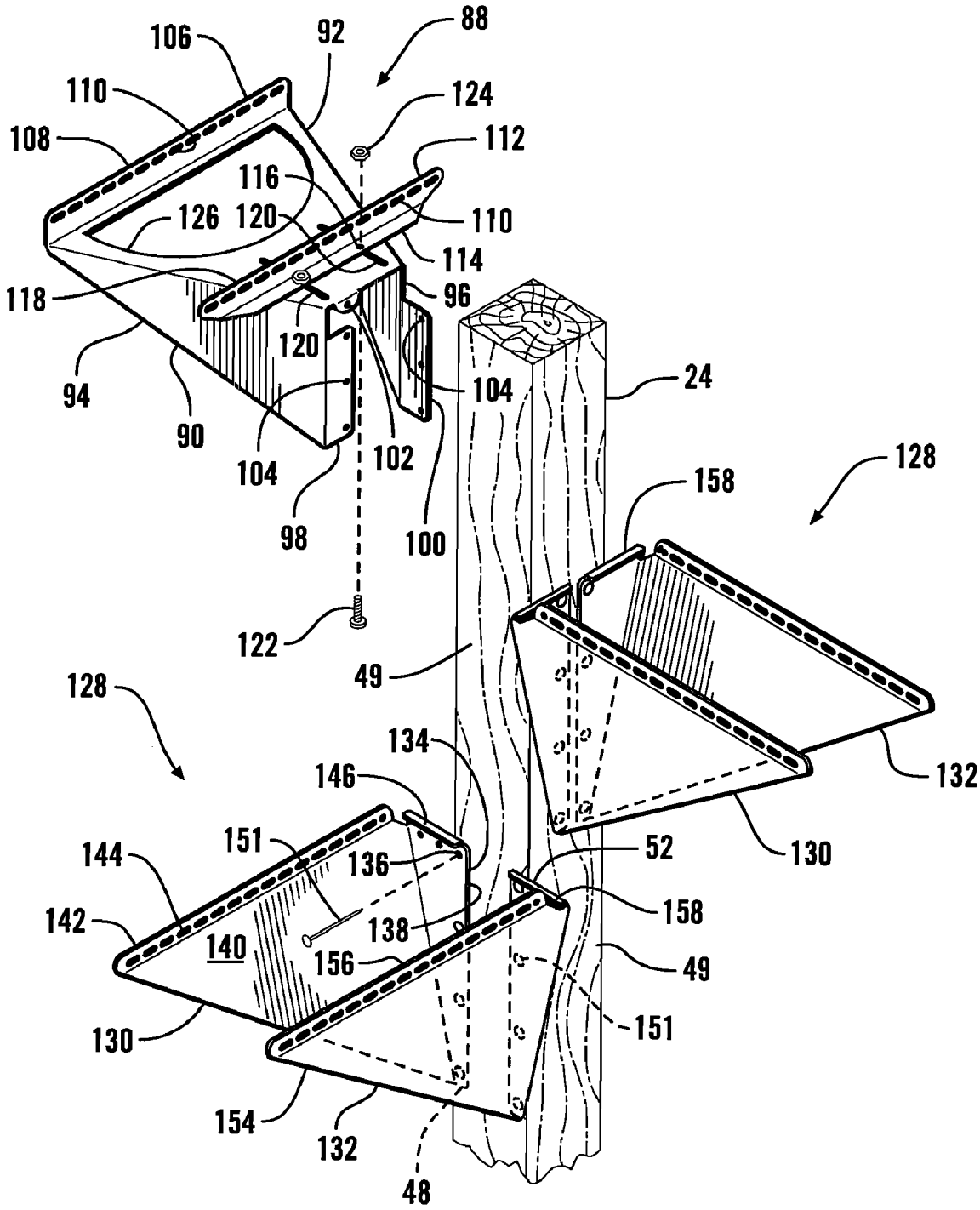
FIG. 3 is an isometric view of a first alternative mailbox mounting assembly of this invention shown in exploded view with respect to a post, and a second alternative mailbox mounting assembly of this invention mounted to the post to accommodate a first mailbox and another like assembly mounted to the post to accommodate a second, narrower mailbox.

An alternative embodiment mailbox mounting assembly 88 is shown in FIG. 3. The assembly 88 has fewer parts than the assembly 20 discussed above, but only allows mounting of the mailbox in a transverse arrangement, where it is spaced from the post. The assembly 88 has a main bracket 90 with a horizontal top wall 92 which underlies the mailbox 22. A first side wall 94 and a second side wall 96 are spaced from one another, and extend downwardly from the main bracket top wall 92. As in the assembly 20, the main bracket 90 is mounted to the post by a rear flange 98, a side flange 100 which extends from the second side wall in a plane which is perpendicular to the top wall and to the rear flange, and a top flange 102 which extends downwardly perpendicular to the top wall. Each of the side flange 100, the top flange 102, and the rear flange 98 has at least one attachment hole 104, through which fasteners may extend into the post.

A first top bracket 106 is formed integrally with the main bracket 90, and has a side segment 108 which extends upwardly from a bottom segment which is defined by the main bracket top wall 92 and is thus non-positionably fixed to the top wall. The side segment 108 has a plurality of aligned side slots 110. A second top bracket 112 has a bottom segment 114 which extends adjacent to the main bracket 90 top wall 92, and which has two fastener holes 116. A second side segment 118 extends upwardly from the bottom 114, and has a plurality of aligned side slots 110. Two parallel slots 120 are formed in the top wall 92 of the main bracket 90. The slots 120 extend in a first direction which extends outwardly from the post 24 towards the first side segment 108. The fastener holes 116 in the second top bracket 112 bottom segment 114 are spaced the same distance apart as are the two slots 120, to allow the second top bracket 112 to be connected to the main bracket 90 by threaded fasteners 122 which engage with nuts 124 which may be fastened to the second top bracket bottom segment 114, and which may be PEMsert® inserts. The second top bracket 112 may thus be fastened to the main bracket 90 at a variable distance from the first top bracket, such that the spacing between the parallel first top bracket side segment 108 and the second top bracket side segment may be adjusted.

The main bracket 90 top wall 92 is preferably provided with an access opening 126 which allows access to the bottom segment of the second top bracket when a mailbox is connected to the side segments of the first bracket and the second bracket. The assembly 84 may be fastened to the post 24 in a fashion similar to that described with respect to the assembly 20 above.

It will be noted that the second top bracket bottom segment 114 preferably extends away from the second top bracket side segment toward the post 24, to permit the downwardly extending lips of a mailbox to be conveniently fastened between the side segment slots of the first top bracket and the second top bracket.

Another alternative embodiment mailbox mounting assembly 128 is also shown in FIG. 3. The assembly 128 is comprised of two mirror image brackets 130, 132 which mount to the same planar vertical surface 49 of the post 24. The first bracket 130 has a generally triangular first post segment 134 which extends adjacent the post planar vertical surface 49. A plurality of fastener holes 136 are positioned, one higher than the other, along an inside edge 138 of the first post segment 134. A first body 140 extends from the first post segment 134 away from the post 24 approximately perpendicular to the first post segment, but not in a strictly vertical plane. A first attachment flange 142, however, extends vertically upwardly from the first body 140. The first attachment flange 142 has a plurality of fastener openings 144. The first post segment 134 has a top edge 146 positioned above a bottom edge 148, with the fastener holes 136 being located between the top edge and the bottom edge. The first body 140 is spaced from the fastener holes 136 a greater distance adjacent the top edge 14 than adjacent the bottom edge 148 of the first post segment 134.

Fasteners 151, for example nails or screws, extend through the fastener openings 136 in the first post segment 134 to fix the first bracket to the post 24 such that portions of the first post segment 134 protrude sidewardly from the post planar vertical surface adjacent the top edge 146.

The second bracket 132 has a second post segment 152 which extends adjacent the post planar vertical surface 49 and which has a plurality of fastener holes positioned one higher than the other. A second body 154 extends from the second post segment 152 away from the post. An attachment flange 156 extends vertically upwardly from the second body, and has a plurality of fastener openings 144. The second post segment 152 has a top edge positioned above a bottom edge, and as on the first post segment, the fastener holes are located between the top edge and the bottom edge. The second body 154 is spaced from the second post segment fastener holes a greater distance adjacent the top edge than adjacent the bottom edge of the attachment flange 156.

The second post segment is connected by fasteners 151 to the same vertical face 49 of the post 24 as the first post segment 134, to connect the second bracket 132 to the post such that portions of the second post segment protrude sidewardly from the post planar vertical surface adjacent the second post segment top edge. A mailbox to be mounted to the post is positioned between the first bracket attachment flange 142 and the second bracket attachment flange 156, and fixed thereto by fasteners which extend through the attachment flange fastener openings 144. It will be noted that the mounting assembly 128 permits the mounting of a mailbox which is wider than the post 24, as the spacing of the first bracket attachment flange 142 from the second bracket attachment flange 156 in a horizontal direction is greater than the horizontal width of the post vertical surface.

As illustrated in the upper assembly 128 on the post 24 in FIG. 3, a narrow mailbox can be mounted to the post by spacing the first bracket 130 closely from or even adjacent to the second bracket 132. As illustrated by the lower assembly 128 on the post 24 in FIG. 3, a wider mailbox can be mounted to the post by a greater spacing of the two brackets 130, 132, even to the point where the majority of each post segment is projecting sidewardly from the post 24.

For additional stiffness, a rim 158 may be formed along the top edge of each post segment.

It should be noted that, if the mounting assemblies of this invention are mounted to the post using screws, the assemblies can easily be removed and reattached to solve problems associated with setting the proper height for postal delivery.

It is understood that the invention is not limited to the particular construction and arrangement of parts herein illustrated and described, but embraces all such modified forms thereof as come within the scope of the following claims.

I claim:

1. An assembly for mounting a mailbox to an upright post, the assembly comprising:

a main bracket having a horizontal top wall, the top wall extending in a first direction from a post edge to a free edge, a first side wall which extends downwardly from the top wall, and a second side wall spaced from the first side wall and which extends downwardly from the top wall;

portions of the main bracket which extend from the first side wall and the second side wall and which define fastener openings for mounting to the post;

portions of the main bracket top wall which define two first openings;

a first top bracket which has a side segment which extends upwardly from the top wall of the main bracket;

a second top bracket having a bottom segment which extends parallel and adjacent to the main bracket top wall, and a side segment which extends upwardly from the bottom segment, wherein portions of the first top bracket side segment and the second top bracket side segment define sidewardly opening fastener holes for engagement of the mailbox therewith; and a plurality of fasteners which mount the second top bracket to the main bracket, the fasteners extending between the second top bracket bottom segment and the main bracket first openings, such that the second top bracket side segment may be positioned in spaced parallel relation to the first top bracket side segment, to permit the mailbox to be engaged therebetween.

2. The assembly of claim 1 wherein the first side wall diverges from the second wall as the walls extend in the first direction, such that the first side wall is not parallel to the second side wall.

3. The assembly of claim 1 wherein a second direction is defined perpendicular to the first direction, and wherein the first side wall is spaced from the second wall in the second direction, and wherein the distance between the first wall and the second wall is greater at the free edge than at the post edge.

4. The assembly of claim 1 further comprising:

a rear flange which extends from the first side wall in a plane which is perpendicular to the top wall; and a side flange which extends from the second side wall in a plane which is perpendicular to the top wall and to the rear flange, the rear flange and the side flange positioned to engage perpendicular faces of the upright post for attachment of the main bracket thereto.

5. The assembly of claim 4 further comprising a top flange which extends downwardly from the top wall at the post edge and which extends in the plane of the rear flange.

6. The assembly of claim 4 further comprising:

portions of the main bracket which define at least one fastener hole in each of the rear flange and the side flange; and portions of the main bracket which define raised crown portions around each fastener hole in the rear flange and the side flange.

7. The assembly of claim 1 wherein the first top bracket side segment is integrally formed with the main bracket top wall and is thereby fixed thereto.

8. The assembly of claim 1 further comprising portions of the top wall which define a first pair of parallel second openings which extend in a direction perpendicular to the first direction.

9. The assembly of claim 8 further comprising a second first opening aligned with each first opening and spaced therefrom across one of the first pair of second openings.

10. The assembly of claim 1 wherein the first top bracket side segment extends upwardly from a bottom segment which extends parallel and adjacent to the main bracket top wall, the first top bracket being positionably mounted to the main bracket top wall.

11. The assembly of claim 10 further comprising:

two fasteners which extend from the first top bracket, the fasteners being spaced from one another a first distance in the first direction, wherein the fasteners which extend from the second top bracket are spaced from one another the first distance in the first direction; and portions of the top wall which define three first parallel second openings spaced from each other in the first direction, the spacing between the second openings being the first distance, such that each fastener extends into one of the second openings.

12. An assembly for mounting a mailbox to an upright post, the assembly comprising:

a main bracket having a horizontal top wall, the top wall extending in a first direction from a post edge to a free edge, a first side wall which extends downwardly from the top wall, and a second side wall spaced from the first side wall and which extends downwardly from the top wall, a rear flange which extends from the first side wall in a plane which is perpendicular to the top wall, a side flange which extends from the second side wall in a plane which is perpendicular to the top wall and to the rear flange, the rear flange and the side flange positioned to engage perpendicular faces of the upright post for attachment of the main bracket thereto;

portions of the main bracket top wall which define two parallel first openings;

a first top bracket which has a side segment which extends upwardly from the top wall of the main bracket, the first top bracket side segment having portions defining a plurality of side fastener holes;

a second top bracket having a bottom segment which extends parallel and adjacent to the main bracket top wall, and a side segment which extends upwardly from the bottom segment and which has a plurality of side fastener holes; and a plurality of fasteners which mount the second top bracket to the main bracket, the fasteners extending between the second top bracket bottom segment and the main bracket first openings, such that the second top bracket side segment may be positioned in spaced parallel relation to the first top bracket side segment, to permit the mailbox to be engaged therebetween.

13. The assembly of claim 12 wherein a second direction is defined perpendicular to the first direction, and wherein the first wall is spaced from the second wall in the second direction, and wherein the distance between the first wall and the second wall is greater at the free edge than at the post edge.

14. The assembly of claim 12 further comprising portions of the top wall which define a first pair of parallel second openings which extend in a direction perpendicular to the first direction, the second openings being configured to alternatively receive the first top bracket fasteners therein.

15. The assembly of claim 14 further comprising a second first opening aligned with each first opening and spaced therefrom across one of the first pair of second openings.

16. The assembly of claim 12 wherein the first top bracket side segment extends upwardly from a bottom segment which extends parallel and adjacent to the main bracket top wall, the first top bracket being positionably mounted to the main bracket top wall.

17. The assembly of claim 16 further comprising:

two fasteners which extend from the first top bracket, the fasteners being spaced from one another a first distance in the first direction, wherein the fasteners which extend from the second top bracket are spaced from one another the first distance in the first direction; and portions of the top wall which define three first parallel second openings spaced from each other in the first direction, the spacing between the second openings being the first distance, such that each fastener extends into one of the second openings.

18. The assembly of claim 12 further comprising:

portions of the main bracket which define at least one fastener hole in each of the rear flange and the side flange; and portions of the main bracket which define raised crown portions around each fastener hole in the rear flange and the side flange.

19. A mailbox post assembly comprising:

an upright post having a planar vertical surface;

a first bracket having a first post segment with portions which extend adjacent the post planar vertical surface and which define a plurality of fastener holes positioned one higher than the other, wherein a first body extends from the first post segment away from the post, and wherein a first attachment flange extends vertically upwardly from the first body, the first attachment flange having portions defining a plurality of fastener openings, wherein the first post segment has a top edge positioned above a bottom edge, with the fastener holes being located between the top edge and the bottom edge, and wherein the first body is spaced from the first post segment fastener holes a greater distance adjacent the top edge than adjacent the bottom edge of the first post segment;

fasteners which extend through the fastener openings in the first post segment to fix the first bracket to the post such that portions of the first post segment protrude sidewardly from the post planar vertical surface adjacent the top edge;

a second bracket having a second post segment with portions which extend adjacent the post planar vertical surface and which define a plurality of fastener holes positioned one higher than the other, wherein a second body extends from the second post segment away from the post, and wherein a second attachment flange extends vertically upwardly from the second body, the second attachment flange having portions defining a plurality of fastener openings, wherein the second post segment has a top edge positioned above a bottom edge, with the fastener holes being located between the top edge and the bottom edge, and wherein the second body is spaced from the second post segment fastener holes a greater distance adjacent the top edge than adjacent the bottom edge of the second post segment;

fasteners which extend through the fastener holes in the second post segment to fix the second bracket to the post such that portions of the second post segment protrude sidewardly from the post planar vertical surface adjacent the second post segment top edge; and a mailbox positioned between the first bracket attachment flange and the second bracket attachment flange, and fixed thereto by fasteners which extend through the attachment flange fastener openings, wherein the spacing of the first bracket attachment flange from the second bracket attachment flange in a horizontal direction is greater than the horizontal width of the post vertical surface.

* * * * *